US007717514B2

(12) United States Patent
Redmann

(10) Patent No.: US 7,717,514 B2
(45) Date of Patent: May 18, 2010

(54) UNIVERSALLY ADJUSTABLE SWIVEL CHAIR

(76) Inventor: Dean Redmann, 2069 County Highway F, Athens, WI (US) 54411

( * ) Notice: Subject to any disclaimer, the term of this patent is extended or adjusted under 35 U.S.C. 154(b) by 130 days.

(21) Appl. No.: 11/859,069

(22) Filed: Sep. 21, 2007

(65) Prior Publication Data

US 2009/0015040 A1 Jan. 15, 2009

Related U.S. Application Data

(60) Provisional application No. 60/826,640, filed on Sep. 23, 2006.

(51) Int. Cl.
*A47C 13/00* (2006.01)

(52) U.S. Cl. ..... 297/313; 297/328; 297/344.26; 297/129; 297/357

(58) Field of Classification Search ..... 297/357, 297/313, 329, 337, 344.26, 328, 129
See application file for complete search history.

(56) References Cited

U.S. PATENT DOCUMENTS

| | | | | | |
|---|---|---|---|---|---|
| 240,476 | A * | 4/1881 | Starr | 297/358 |
| 717,026 | A * | 12/1902 | Ostendorf | 297/320 |
| 778,526 | A * | 12/1904 | Bennett | 297/320 |
| 984,939 | A | 2/1911 | Krile | |
| 1,294,378 | A * | 2/1919 | Barnes | 297/111 |
| 1,947,410 | A * | 2/1934 | Emerson | 297/39 |
| 2,292,414 | A * | 8/1942 | Vernon | 297/313 |
| 2,450,783 | A | 10/1948 | Collins | |
| 3,385,632 | A * | 5/1968 | Scelzi | 297/357 |
| 3,589,661 | A | 6/1971 | Harris | |
| 3,975,050 | A * | 8/1976 | McKee | 297/328 |
| 4,074,886 | A * | 2/1978 | Yates | 248/394 |
| 4,304,384 | A * | 12/1981 | Cremer et al. | 248/397 |
| 4,561,621 | A * | 12/1985 | Hill | 248/397 |
| 4,772,068 | A | 9/1988 | Gleckler | |
| 5,246,265 | A | 9/1993 | Nagan | |
| 5,908,220 | A * | 6/1999 | Bauer et al. | 297/284.1 |
| 6,015,190 | A | 1/2000 | Wend | |
| 6,102,479 | A * | 8/2000 | Wallace | 297/357 |
| 6,250,712 | B1 | 6/2001 | Livington et al. | |
| 6,595,593 | B2 * | 7/2003 | Elam | 297/463.1 |
| 6,820,928 | B1 | 11/2004 | Ransom | |
| 6,983,992 | B2 * | 1/2006 | Oomori | 297/357 |
| 7,032,965 | B2 | 4/2006 | Howell et al. | |
| 7,147,277 | B1 * | 12/2006 | Miller | 297/19 |
| 7,540,566 | B2 * | 6/2009 | Struzzieri | 297/337 |
| 2006/0103207 | A1 * | 5/2006 | Marchand et al. | 297/313 |
| 2009/0206643 | A1 * | 8/2009 | Yamamoto | 297/313 |

* cited by examiner

*Primary Examiner*—David Dunn
*Assistant Examiner*—James Alex
(74) *Attorney, Agent, or Firm*—Lane Patents LLC

(57) ABSTRACT

A chair designed for outdoor use, in particular various hunting applications. The chair is independently adjustable in the seat platform, the legs and the seatback to meet the different requirements for hunting various types of game, such as reclining for fowl flying above, or upright for land animals. It is also mounted on a swivel for quickly pivoting to follow the movement of game. The invention can be used in conjunction with blinds, or can include a pop up tarp for partially concealing the hunter. The seat is not just useful for hunters, but other outdoor enthusiast that want to view wildlife easily and in comfort.

19 Claims, 6 Drawing Sheets

UNIVERSALLY ADJUSTABLE SWIVEL CHAIR

CROSS-REFERENCE TO RELATED APPLICATIONS

The present application is a continuation-in-part application of U.S. provisional patent application, Ser. No. 60/826,640 filed Sep. 23, 2006, for UNIVERSALLY ADJUSTABLE SWIVEL CHAIR, included by reference herein and for which benefit of the priority date is hereby claimed.

FIELD OF THE INVENTION

The present invention is directed to a seat or chair. More specifically it is directed toward creating a multipurpose chair that can be used by outdoor enthusiasts and hunters that swivels to supply rapid movement needed to follow game or other animals, and can be independently adjusted at the seat, seatback and legs to allow for various conditions of terrain and the needs of the user to comfortably view their subject, whether it be on water, land, in trees or sly. If the user is a hunter, other attachments such as bipod rests, or hooded structures can be added to increase the utility of the invention.

BACKGROUND OF THE INVENTION

Various inventions have been used and patented in the past for outdoor enthusiasts, thus showing the need and popularity of such inventions. None of the patents found, nor products seen, have combined the versatility of seat, leg and backrest positions with the ability to pivot or swivel quickly.

U.S. Pat. No. 984,939 issued to Krile, discloses a folding camp chair with a latched base and an adjustable back hinged to the seat. However it does not have a swivel base needed to quickly turn and locate sources of game, or other items of interest to the user.

U.S. Pat. No. 2,450,783 issued to Collins, discloses a beach or lawn chair with a combination head rest and back rest. It also discloses a flexible seat with a similar seating position as the current invention. It too lacks the swivel base of the current invention.

U.S. Pat. No. 3,589,661 issued to Harris, discloses a hunting chair with a swivel seat. It is also designed for portability. It does not include backrest, adjustable tilt or other features of the present invention.

U.S. Pat. No. 4,772,068 issued to Gleckler, discloses a camping chair with the ability to adjust the incline of the seat and back. This does not include the swivel of the present invention, and is more cumbersome in its folding and locking mechanism.

U.S. Pat. No. 5,246,265 issued to Nagan, discloses the classic chaise lounger. A lounge chair with legs, back rest and foot rest which engage in a variety of locking positions for comfort. They permit the elevation of the sitter to be varied. This disclosure, however, does not include the ability to swivel or pivot easily. It is also more bulky than the present invention.

U.S. Pat. No. 6,015,190 issued to Wend, discloses a folding portable hunting seat. It is portable but does not have the number of variations of seat and backrest positions available in the current invention. It also does not include the ability to swivel or pivot easily.

U.S. Pat. No. 6,250,712 issued to Livingston, discloses a portable folding chair with a frame, upper and lower body support, which can be carried by the user. This method of reclining, however, does not automatically adjust the leg (thigh) support. It also requires some sort of strapping between the back angle support and the base of the chair to maintain support. The seat is not adjustable, and it does not include the ability to pivot easily.

U.S. Pat. No. 6,820,928 issued to Ransom, discloses a low profile seat with repositionable backrest. The leg assemblies have different heights to be positioned on uneven terrain. It also allows hunters a repositionable back rest which can be moved from one side to the other to change the direction of fire. Without the swivel, however, it does not allow the hunter to swing into position in 'real time' while hunting.

U.S. Pat. No. 7,032,965 issued to Howell, discloses a hunting chair with a swivel base. It is not low profile which is important in cases where the hunter needs to be inconspicuous. It also does not allow the same type or number of reclining and seating positions as the current invention.

SUMMARY OF THE INVENTION

The current invention provides a way for hunters and other outdoor enthusiasts to be seated comfortably in a wide variety of situations. The current invention consists of; a chair base, adjustable and removable legs, a swivel, adjustable seat platform, an adjustable seatback assembly to change the incline of the seatback, and optionally a head rest, shooting range or other attachments that can be inserted into the end openings of the vertical support rods or mounting frame. Each of these features combines in such a way to allow for a wide range of seating comfort, maneuverability, and portability of the present invention.

It is an advantage of the invention that it can be carried from location to location by one person;

It is another advantage of the invention that it can be adjusted in both the seat platform and the seatback to allow for the various seating positions required in hunting. For example it can be set up in a very upright position for animals such as deer, or can be reclined for overhead viewing of fowl flying through the air.

It is another advantage of the invention that even while in the reclined position, the seat can easily be swiveled.

It is another advantage of the invention that the available adjustments reduce fatigue by allowing various settings in the seat platform and seatback;

It is another advantage of the invention that the swivel allows for the quick turning response needed to locate or track game that can come from any direction, including behind the hunter;

It is another advantage of the invention that elevation of the seat platform by adjustable legs insulates a hunter from the cold, hard, wet ground.

It is another advantage of the invention that it provides a low profile, which is important because many hunters try to be as inconspicuous as possible, yet be in position to see clearly.

It is another advantage of the invention that it allows the hunter to survey the terrain easily while still being in a low or crouched position.

BRIEF DESCRIPTIONS OF THE DRAWINGS

The invention illustrated in the accompanying drawings, in which the same reference characters indicate the same parts in all views in which.

Figure 7A:
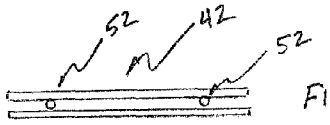

FIG. 7*a* shows a frontal view of a swivel base assembly.

Figure 7B:
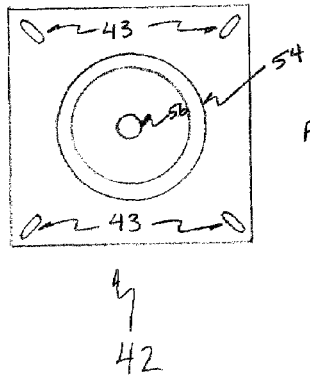

FIG. 7*b* shows a top view of a swivel base assembly.

Figure 8A:
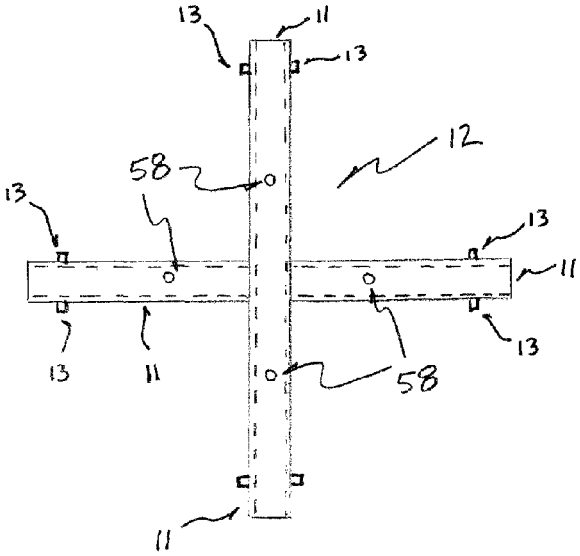

FIG. 8*a* shows a top view of a leg mount.

Figure 8B:
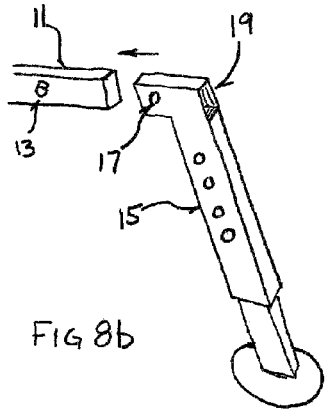

FIG. 8*b* shows a perspective view of a preferred embodiment of a leg mount and legs.

Figure 9A:
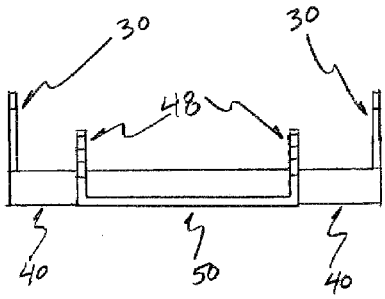

FIG. 9*a* shows a front view of a mounting base without a seat platform.

Figure 9B:
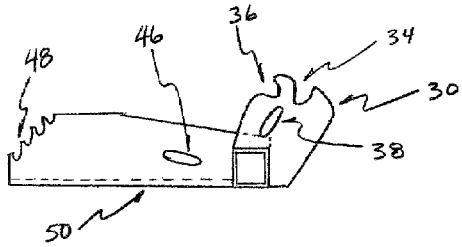

FIG. 9*b* shows a side view of a mounting base without a seat platform.

Figure 9C:
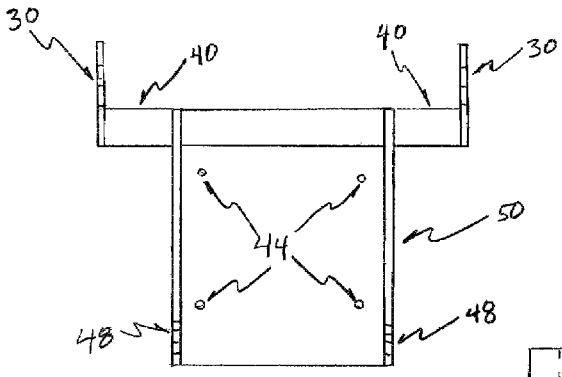

FIG. 9*c* shows a top view of a mounting base without a seat platform.

Figure 10A:
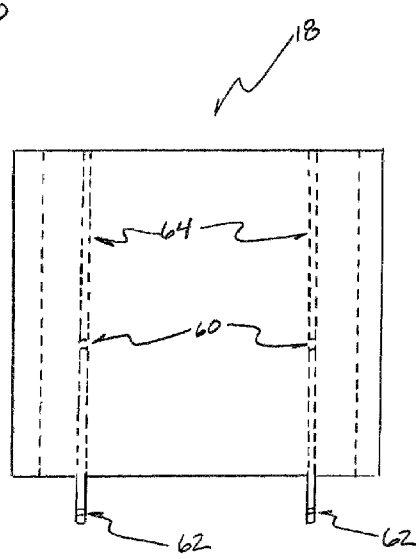

FIG. 10*a* shows a top view of a seat platform.

Figure 10B:
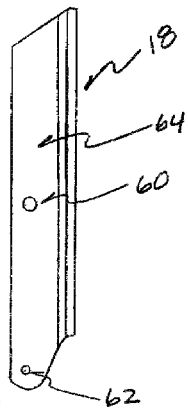

FIG. 10*b* shows a lateral view of a seat platform.

Figure 11:
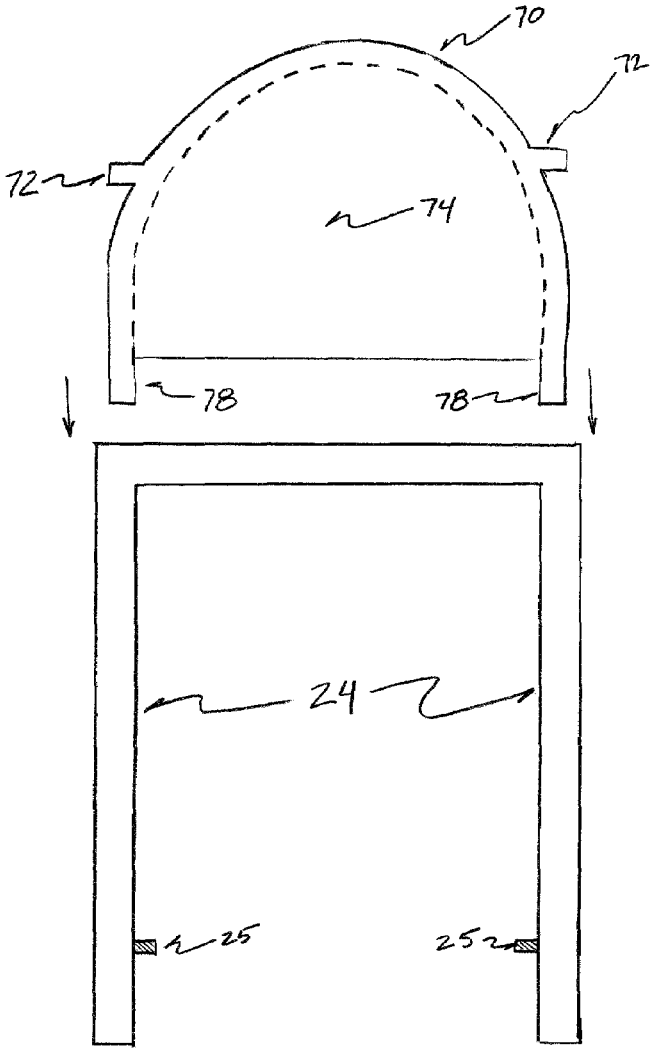

FIG. 11 shows a front view of an alternate embodiment seatback.

Figure 11A:
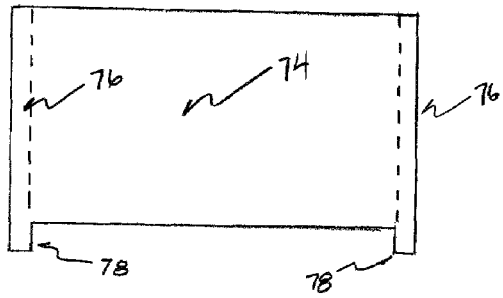

FIG. 11*a* shows a front view of an alternate embodiment seatback.

Figure 12A:
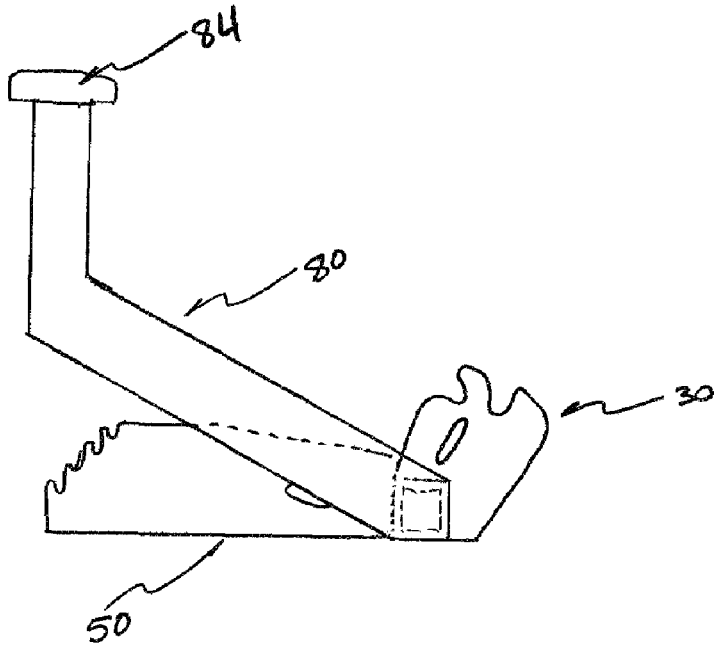

FIG. 12*a* shows a side view of an optional bipod attachment.

Figure 12B:
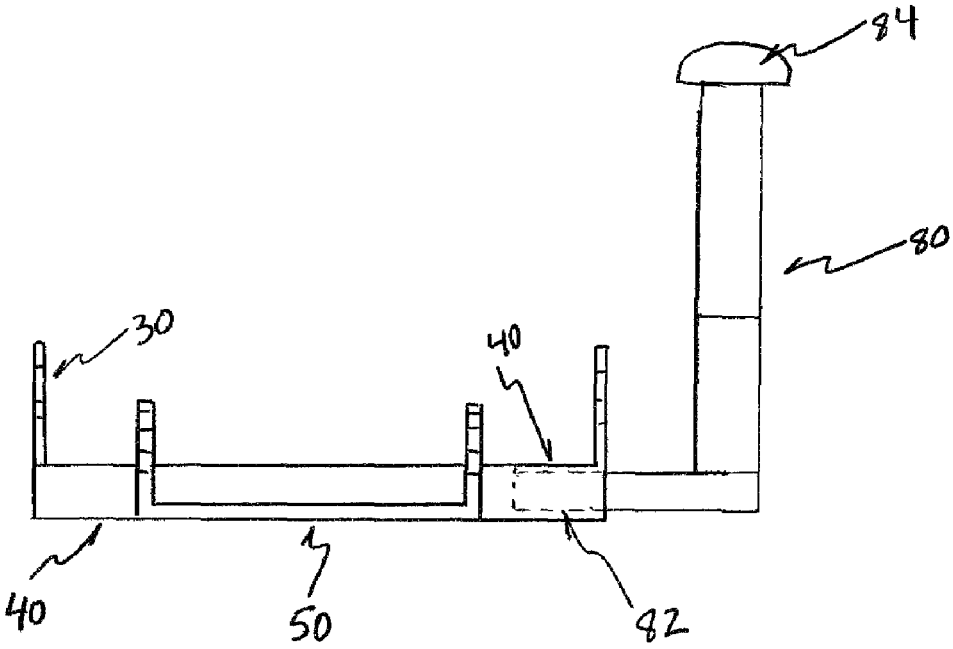

FIG. 12*b* shows a front view of an optional bipod attachment.

DETAILED DESCRIPTION OF THE DRAWINGS

Figure 1:
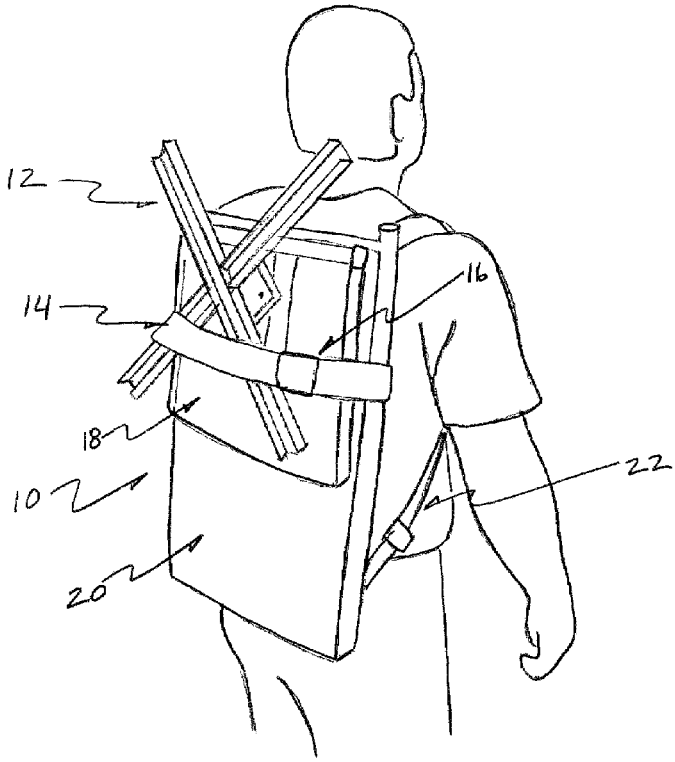
FIG. 1 shows a perspective view of the present invention being ported to a use location.

Referring now to the drawings, FIG. 1 illustrates in perspective view a person porting a comfort chair adjustable hunting chair (10) in a folded and compact position to a location for use. Adjustable carrying slings (22) are secured to the rear side of the seatback (20). The carrying slings allow a person to carry the chair. The comfort chair can be upholstered to add comfort along the seatback (20) and seat platform (28). A strap (14) and buckle (16) are attached or sewn to the lower rear of the seatback (20) and are wrapped around the leg mount (12) and the seat platform (18), securing the seatback (20) to the leg mount (12) and seat platform (18).

Figure 2:
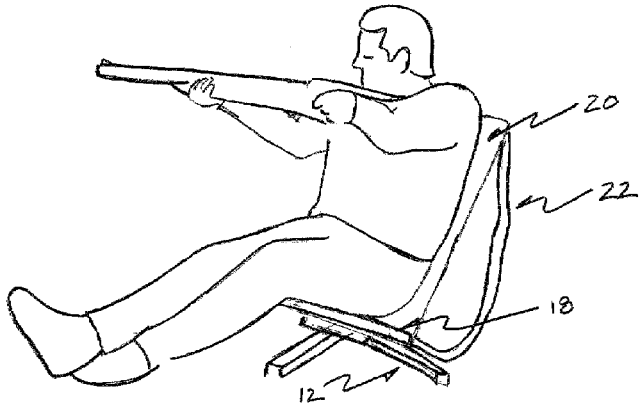
FIG. 2 shows a perspective view of the present invention being used in an upright position.

FIG. 2 illustrates in perspective view a person hunting while seated in a comfort chair (10) with the seat platform (18) in the highest position and the seatback (20) in an upright position. The carrying slings (22) trail down behind the seatback (20). The leg mount (12) serves as the foundation of the chair in this illustration but greater clearance may be accomplished by inserting legs with extensions into the lateral openings of the leg mount (12). The removal of the leg mount (12) is another possible embodiment, whereby the swivel (42) acts as the lowermost foundation for the comfort chair (10).

Figure 3:
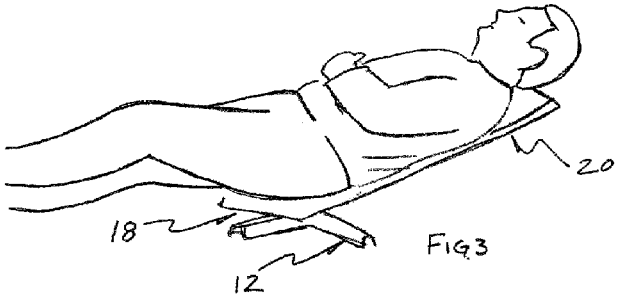
FIG. 3 shows a perspective view of the present invention being used in a reclining position.

FIG. 3 illustrates in perspective view a person enjoying a comfort chair (10) while in a reclining position. In this position the seat platform (18) may be in any position; high, low, or intermediate, depending upon preference, and the seatback (20) is in a reclining position.

Figure 4:
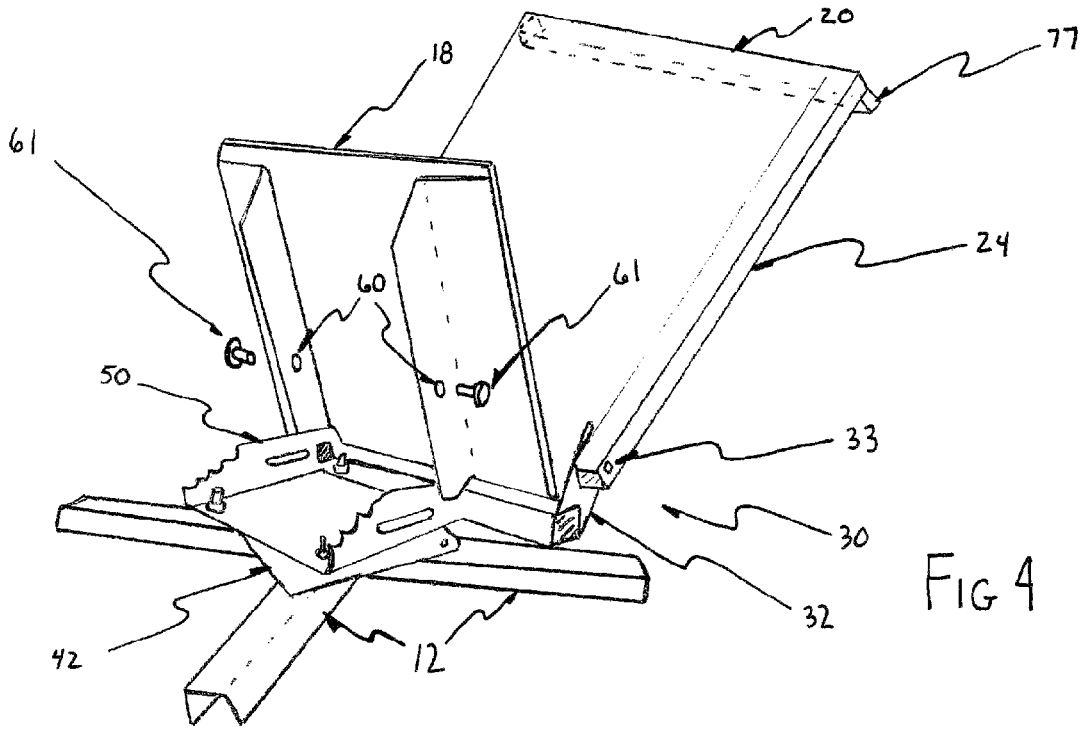
FIG. 4 shows an exploded view of the present invention with the seat platform raised, showing how the seat platform can be attached to the mounting base.

FIG. 4 illustrates an exploded view of some basic elements of a comfort chair (10). The leg mount (12) is bolted, welded, or otherwise fastened firmly to the swivel (42) and the swivel (42) fastens firmly to the seat platform (18). The swivel is the type typically found in hardware stores and is used in furniture designs of many styles. Bolted, welded, or otherwise attached to the top of the swivel (42) is a mounting base (50). In the back of the mounting base (50), protruding laterally from both sides, are two mounting rods (40). At the distal ends of each mounting rod (40) is found a vertical frame (32) which accommodates the mounting of a vertical support rod (24), forming the vertical portion of a seatback (20). A preferred embodiment provides a cushion for the seat platform (18) and a canvas that acts as a seatback (20) and snaps along the horizontal support rod (77) and vertical support rods (24), stretching between the vertical support rods (24) and over the seat platform (18) and cushion. The canvas can be of any design or color, preferably an earth tone color or camouflage pattern. Adjustable carrying slings (22) are secured to the rear side of the seatback (20) between the horizontal support rod (77) of the seatback (20), and the mounting rods (40) of the mounting base (50). Each support wall (64) of the seat platform (18) is connected to a seat platform fastening slot (46) of the mounting base (50) by a nut, flange, or other fastener through a seat fastening hole (62). In a preferred embodiment, a single bolt is threaded through each seat fastening hole (62), securing each support wall (64) to each seat platform fastening slot (46). Each positioning rod hole (60) of the support wall (64) accommodates a positioning rod (61), pin, bolt or other fastener. The positioning rod (61) slides into a chosen seat position stop (48) to adjust the incline of the seat support (64).

Figure 5:
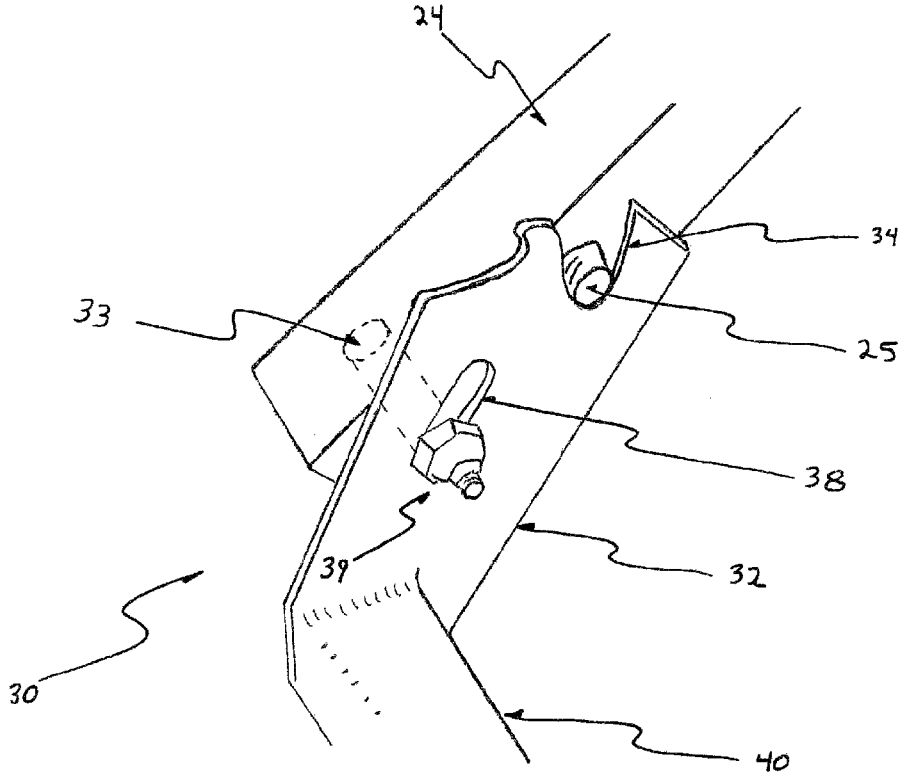
FIG. 5 shows a perspective view close up of a seatback adjustment assembly.

FIG. 5 illustrates in perspective view a close tip showing the operation of a seatback adjustment assembly (30), a mounting rod (40), which can be metal or wood, but preferably metal, with a structure which can be a radial rod, i-beam, squared rod, or any number of structurally sound rod like embodiments, is securely attached or welded to a vertical frame (32) which is generally made from metal. The vertical frame (32) is used to affix a vertical support rod (24) and set the inclination of that rod (24) relative to the mounting base (50). In one embodiment, the vertical support rod (24) is affixed to the vertical frame (32) by means of an adjustable fastener (39) which can be a bolt, rod, pin or other fastener, inserted through a support rod attachment hole (33) on each vertical support rod (24) and a fastening slot (38) located on each vertical frame (32). The seatback fastening slot (38) is elongated to allow free movement of the adjustable fastener (39) as the seatback (20) is adjusted. The size of the elongated slot restricts the range of where an adjustment pin (25) contacts a vertical frame (32), in part because the adjustment pin (25) is placed in a more vertical position than an adjustable fastener (39) along the vertical support rod (24). The recline of the chair is adjusted by placing an adjustment pin (25), which can be a bolt and nut of suitable strength, such as steel or aluminum, preferably nylon threaded, or other type of rod which is inseparably attached to the vertical support rod (24), upon the reclining backrest position stop (34) or the upright position stop (36). The adjustable fastener maintains a firm attachment of the seatback (20) to the vertical frame (32) of the mounting base (50) while the recline is being adjusted, because the adjustable fastener moves freely within the elongated adjustment slot. Other embodiments can be anticipated where more stops can be added, or the relative positions of all the components or their similar functions as described herein, are moved.

The chair is foldable by lifting the seatback (20) in such a way to free the adjustment pin (25) from either position stop. The position of each adjustment pin (25) relative to the vertical frame (32), when the seatback (20) is attached to the mounting base (50) as previously described, inhibits folding the seatback (20) away from the top of the seat platform (18). The seatback (20) is foldable towards the top of the seat platform (18) when each adjustment pin (25) is liberated from any position stop. Once folded, the adjustable fastener (39)

maintains a firm attachment of the seatback (20) to the vertical frame (32) of the mounting base (50). Other embodiments can be anticipated which attach the seatback (20) to the mounting base (50) using a hinge, chain, flexible anchor or similar joint, or other devices and configurations that restrict the movement of a seatback (20) toward a seat platform (18) as herein described.

Figure 6:
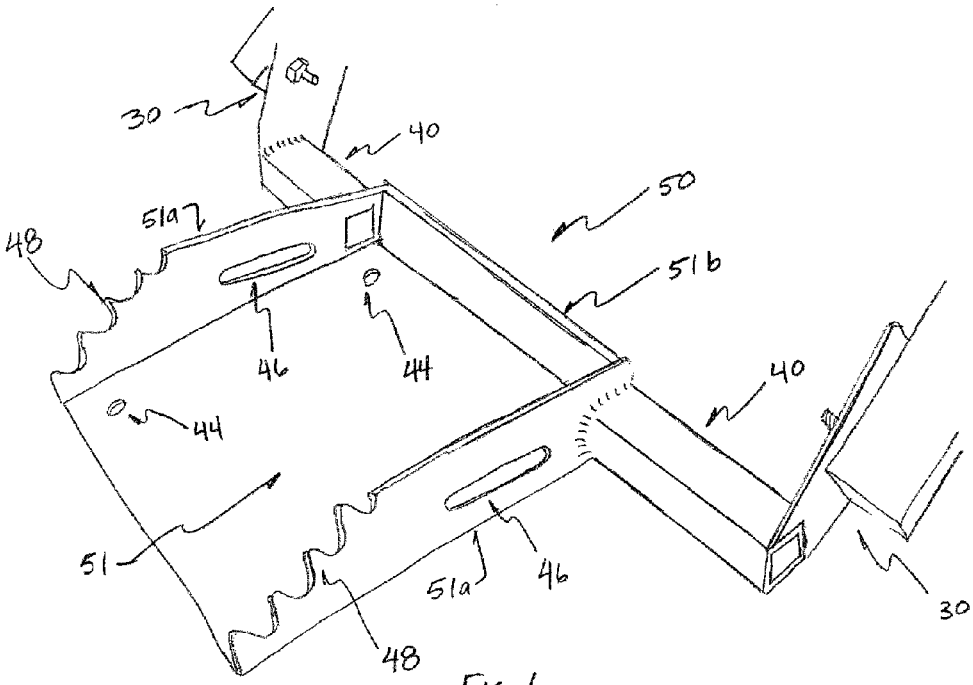
FIG. 6 shows a perspective view close up of a mounting base without a seat platform.

FIG. 6 illustrates in perspective view a close up of the mounting base (50) showing its features in more detail. In one embodiment, a mounting rod (40) is connected to the back of the mounting base (50) either as one long piece through the mounting base (50). However a preferred embodiment is to have segments extending from each vertical wall (51*a*) as shown in the figure. The mounting base (50) is comprised of a flat substantially rectangular floor section (51) with mounting base attachment holes (44) drilled through the floor section (51). On two sides of the floor section (51) are vertical wall (51*a*) members raising from each edge of the mounting base (50). These vertical wall (51*a*) members are substantially mirror images of each other and, in at least one preferred embodiment, contain a seat platform fastening slot (46) that acts as an adjustment runner. An inclining row of sprocketed teeth along the front face of said vertical walls operate as seat platform position stops (48). As shown in FIG. 4, a positioning rod (61) is inserted through a positioning rod hole (60) of the support wall (64). The positioning rods (61) are placed on the desired seat platform position stops (48). The seat platform fastening slot (46) allows laterally free movement of the seat platform (18) while the seat platform position stops (48) are being selected. Other embodiments can be anticipated which attach the seat platform (18) to the mounting base (50) using a hinge, chain, flexible anchor or similar joint, or change the orientation of the seat platform position stops (48) along the vertical walls.

FIG. 7*a* illustrates a frontal view, and FIG. 7*b* illustrates a top view of a typical swivel (42). The swivel (42) can be found in many office furniture supply sources, such as Abacus, and generally consists of an upper and lower plate with a race (54) in each. Bearings (52) in a race (54) allows the upper and lower plates to rotate about a pivot (56). The swivel (42) is mounted between the legs (12) and the mounting base (50) by aligning the swivel mounting slots (43) with their respective mounting base attachment holes (44) or leg mount slots (45) with their respective leg mount holes (58) and securing with a bolt, rod, weld, or other attachment means. In a preferred embodiment as shown it consists of a commercially available swivel being bolted between the leg mount (12) and the mounting base (50).

FIG. 8*a* illustrates a top view of a leg mount (12) which provides a platform for the entire seating assembly, and can consist of a multiplicity of rods, poles, one monolithic piece such as a disk and can be made of metal, wood, plastic, or other rigid material as chosen by the manufacturer. The leg mount (12) is attached to a swivel by inserting a bolt, nut, weld or other attachment through leg mount holes (58). Other embodiments of the leg mount (12) might include different structures, holes, openings, hinges, springs or other means to attach legs to the leg mount (12).

FIG. 8*b* illustrates a perspective view of a preferred embodiment of the leg mount (12) comprising four beams (11), welded in a cross-shape, with leg mount snaps (13) on the side of each beam (11). In this particular embodiment, the legs (15) are removable and adjustable, and are attached to the leg mount (12) with a mounting tunnel (19), which is a squared tube attachment lined with snap holes (17). The mounting tunnel (19) of each leg (15) can be slid over the leg beam (11) until the snap holes (17) are secured by the leg mount snaps (13). The legs (15) can be secured to the leg mount (12) while the chair is in transit by rotating the mounting tunnel (19) until the legs are coplanar with the beams (11) of the leg mount (12). In another embodiment, a leg mount constructed with hollow squared rods could accommodate the insertion of legs or extensions. Other embodiments can be anticipated where changes and variations can be made to the size, attachment, and orientation of any or all the components listed herein.

FIGS. 9*a, b*, and *c*; illustrate a detail view of a mounting base (50) assembly. This assembly has been discussed in detail in the preceding discussions. It is included here to better illustrate a preferred embodiment for the present invention.

FIG. 10*a*, and *b*; illustrate a detail view of a seat platform (18). This seat platform (18) has been discussed in detail in the preceding discussions. It is included here to better illustrate a preferred embodiment for the present invention. The seat platform (18) is attached to a support wall (64) which provides a positioning rod hole (60) and seat fastening hole (62).

FIG. 11 shows an alternative embodiment for the present invention which includes an additional attachment head rest insert (70) which is attached or inserted into each of the hollow vertical support rods (24) and provides support for the user's head. This embodiment includes an attachment pin (72) which can be used to attach a hood to shade or cover the user.

FIG. 11*a* shows an alternative embodiment for the head rest insert (70) which consists of support posts (76) with material or webbing (74) between them. The two support posts (76) are inserted their respective vertical support rods (24) which holds the material or webbing (74) taught, thus providing support. When not required, the support posts (76) can be removed and folded easily for storage. Other embodiments of the head rest insert could include a rain cover, a pop-up tarp, hooded cover or similar attachment. The horizontal support rods and mounting rods are also hollow, allowing insertion of similar insertions and extensions useful to the user.

FIGS. 12*a* and *b* shows a side view and front view of an alternate embodiment optional bipod attachment (80) for resting or steadying a gun, camera, binoculars or other implements to the chair. The bipod attachment (80) is mounted by inserting the bipod insert (82) into an inner perimeter of a mounting rod (40). It then makes the bipod rest (84) available to the user. Other embodiments of the bipod attachment could include incorporating the horizontal or vertical support rods to steady a bipod, or provide an arm or gun rest.

Since other modifications and changes varied to fit particular operating requirements and environments will be apparent to those skilled in the art, the invention is not considered limited to examples chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A universally adjustable swivel chair which is portable and provides a variety of seat and back positions for the comfort of the user, comprising:

a) a support frame whereby a seatback, a seat platform and a swivel are attached to said support frame;

b) a connecting means for connecting said seat platform to said support frame;

c) an attaching means for attaching said seatback to said support frame;

d) a mounting means for mounting said swivel to said support frame;

e) a seat adjustment means for independently positioning the incline of said seat platform; the seat adjustment means further comprising, i. a mounting base having a floor section being substantially rectangular in shape, having at least two vertical wall members, each wall member extending orthogonally from a perimeter region on the bottom of said floor section;

ii. a substantially inclining row of sprocketed teeth along each said front end of said wall member, whereby said srocketed teeth provide a plurality of seat platform position stops;

f) a recline adjustment means for independently positioning the recline of said seatback;

g) a folding means for folding said seat platform toward said seatback; and h) a carrying means for carrying said chair.

2. The chair of claim 1, wherein said connecting means for connecting said seat platform to said support frame, further comprises:

a) said seat platform comprising an upper face, and a lower face, said seat platform further comprising at least one support wall attached to said lower face, each said support wall substantially aligned along the depth of said seat platform and spaced a predetermined width apart;

b) each said support wall comprising a front section, a middle section and a rear section, each said support wall further comprising a fastening hole at a predetermined location of said rear section.

c) a fastener, whereby said fastener secures each said support wall to each said vertical frame, by fastening said fastener through said fastening hole and said seat platform fastening slot.

3. The chair of claim 2, wherein said seat adjustment means for independently positioning the incline of said seat platform further comprises: a positioning hole at a predetermined location of each said middle section and an adjustment rod inserted through each said positioning hole, whereby the incline of said seat platform may be adjusted by placement of said adjustment rod between said teeth.

4. The chair of claim 2, wherein the attaching means for attaching said seatback to said support frame, further comprises:

a) Said seatback comprising a horizontal support rod attached to a pair of vertical support rods, each said vertical support rod having a bottom segment, top segment, interior facing and exterior facing, whereby said horizontal support rod is attached to said top segment of each vertical support rod, forming a frame for said seatback;

b) an adjustment pin protruding from each said interior facing of each said bottom segment, whereby each said adjustment pin is coaxial to the other;

c) a support rod attachment hole located at a predetermined position below each said adjustment pin, said support rod attachment hole going through said interior facing and said exterior facing along the same axis, each said support rod attachment hole being substantially coaxial to the other;

d) an adjustable fastener, whereby said adjustable fastener attaches each said vertical support rod to said seatback fastening slot, by fastening said adjustable fastener through said support rod attachment hole and said seatback fastening slot.

5. The chair of claim 4, wherein said recline adjustment means for independently positioning the recline of said seatback, further comprises: placement of said adjustment pin upon said seatback position stop.

6. The chair of claim 4, wherein said folding means for folding said seat platform toward said seatback, further comprises: a predetermined orientation among the height of said back, the length and angle of said seatback fastening slot, and position of said adjustment pin relative to said support rod attachment hole, whereby when said adjustment pin is liberated from any said seatback position stop, said seatback is restricted to move radially toward said upper face.

7. The chair of claim 6, wherein said seatback is secured to said seat platform.

8. The chair of claim 7, wherein said fastening means is a strap, buckle, cord, snap, or other tie.

9. The chair of claim 4, wherein each end of each said vertical support rod is hollow, to allow insertion of removable support posts that are of smaller diameter than the interior walls of each said vertical support rod.

10. The chair of claim 9, wherein material or webbing is attached between each said support post, forming a head rest insert, whereby said head rest insert may be removed and folded when not in use.

11. The chair of claim 4, wherein each said mounting rod is hollow, to allow insertion of attachment rods that are of smaller diameter than the interior walls of said mounting rod.

12. The chair of claim 11, wherein a removable bipod attachment is mounted by inserting a bipod insert into said mounting rod, whereby a bipod rest is made available to the user.

13. The chair of claim 4, wherein the carrying means comprises a plurality of adjustable shoulder straps attached between said horizontal support rod and each said mounting rod, whereby a person can carry the chair on his or her back without fatigue or restriction of movement.

14. A universally adjustable swivel chair which is portable and provides a variety of seat and back positions for the comfort of the user comprising:

a) a support frame whereby a seatback, a seat platform and a swivel are attached to the support frame;

b) a connecting means for connecting said seat platform to said support frame;

c) an attaching means for attaching said seatback to said support frame;

d) a mounting means for mounting said swivel to said support frame;

e) a seat adjustment means for independently positioning the incline of said seat platform, the seat adjustment means further comprising:

i. a mounting base having a floor section being substantially rectangular in shape, having at least two vertical wall members, each said wall member extending orthogonally from the perimeter region on the bottom of said floor section;

ii. each said wall member comprising a front end, a rear end, and a mid portion, said wall member further comprising an inner face and an outer face, each said wall member further comprising a substantially enlongated seat platform fastening slot located on a predetermined location of said mid portion, the major axis of said seat platform fastening slot having a predetermined alignment along said wall member;

iii. a substantially inclining row of sprocketed teeth along each said front end of said wall member, whereby said teeth provide a plurality of seat platform position stops;

iv. mounting rods extending laterally from said rear end of said outer face of each said wall member, each said mounting rod having a vertical frame extending substantially upward from the distal end of each said mounting rod;

f) a recline adjustment means for independently positioning the incline of said seat platform, comprising;

i. each said vertical frame comprising a front, a back, an upper end, a lower end and center portion comprising an inside face and an outside face, said back being longer than said front, each said vertical frame further comprising a substantially elongated seatback fastening slot located on a predetermined location of said center portion, the major axis of said seatback fastening slot having a predetermined alignment along said vertical frame;

ii. a plurality of seatback position stops.

g) a folding means for folding said seat platform toward said seatback; and h) a carrying means for carrying said chair.

15. The chair of claim 14, wherein said mounting means for connecting said swivel to said support frame further comprises: said swivel comprising an upper plate, a lower plate and a plurality of swivel mounting slots at a predetermined location on said upper plate, said lower plate comprising a plurality of leg mount slots at a predetermined location on said lower plate, a plurality of attachment holes at a predetermined location on said mounting base, whereby said swivel mounting slots are aligned with said attachment holes and secured with a bolt, rod, weld, or similar fastener.

16. The chair of claim 15, wherein a leg mount, comprising a plurality of beams, each said beam having an upper mount face, an interior segment, an exterior segment and sides, each said beam further comprising a plurality of leg mount holes at a predetermined location on said upper mount face, whereby said leg mount slots are aligned with said leg mount holes and secured with a bolt, rod, weld, or similar fastener, connecting said leg mount to said swivel.

17. The chair of claim 16 wherein a plurality of removable legs can be attached to said leg mount.

18. The Chair of claim 17, wherein each said leg further comprises a mounting tunnel at the anterior end of said leg, said mounting tunnel comprising a plurality of snap holes, said beam further comprising leg mount snaps attached at each said side along said exterior segment, whereby each said beam is inserted into said respective mounting tunnel, until said leg mount snaps are secured into said respective snap holes.

19. The chair of claim 17, wherein the legs are constructed to provide a low seating profile.

* * * * *